United States Patent [19]

Sato et al.

[11] 4,149,890

[45] Apr. 17, 1979

[54] DIFFUSION TRANSFER PHOTOGRAPHIC MATERIAL WITH FLUORINE CONTAINING NEUTRALIZATION LAYER

[75] Inventors: Yuzuru Sato, Hachioji; Masao Asano, Tokyo; Masao Ishihara, Hino; Sadatugu Terada, Hachioji, all of Japan

[73] Assignee: Konishiroku Photo Industry Co., Ltd., Tokyo, Japan

[21] Appl. No.: 804,567

[22] Filed: Jun. 8, 1977

[30] Foreign Application Priority Data

Jun. 16, 1976 [JP] Japan ..... 51-70516

[51] Int. Cl.[2] ..... G03C 7/00; G03C 5/54; G03C 1/48; G03C 1/40

[52] U.S. Cl. ..... 96/76 R; 96/3; 96/29 D; 96/77

[58] Field of Search ..... 96/119 R, 76 R, 77, 96/3, 29 D, 114; 428/421, 522; 520/250, 251, 255, 242, 245, 247, 248

[56] References Cited

U.S. PATENT DOCUMENTS

| | | | |
|---|---|---|---|
| 3,294,619 | 12/1966 | Noland | 428/421 |
| 3,449,305 | 6/1969 | Stilmar | 428/421 |
| 3,451,978 | 6/1969 | Chalmers et al. | 428/421 |
| 3,880,658 | 4/1975 | Lestina et al. | 96/77 |

*Primary Examiner*—Richard C. Schilling
*Attorney, Agent, or Firm*—Bierman & Bierman

[57] ABSTRACT

There is disclosed an improvement in a diffusion transfer photographic material having a transparent support, a receiving layer, a silver halide emulsion layer, and a neutralization layer, wherein the neutralization layer contains a copolymer containing fluorine.

13 Claims, No Drawings

DIFFUSION TRANSFER PHOTOGRAPHIC MATERIAL WITH FLUORINE CONTAINING NEUTRALIZATION LAYER

This invention relates to photographic materials for a diffusion transfer process in which images of metallic silver or dyes are formed by diffusion transfer. More particularly, the invention is concerned with novel photographic materials to be used in diffusion transfer process (hereinafter referred to as diffusion transfer photographic materials) so that alkalinity in the system can be substantially decreased without interferring with the formation of diffusion transfer images.

As diffusion transfer photographic materials have been hitherto known silver salt diffusion transfer photographic materials and color diffusion transfer photographic materials.

In silver salt diffusion transfer photographic materials, a light-sensitive silver halide emulsion, after imagewise exposed to light, is developed with an alkaline processing composition. During the processing, the image-forming substance comprising a silver complex salt formed from the silver halide in the unexposed area by used of a silver halide solvent or a complex forming agent is diffused in to a silver-precipitating layer (or an image-receiving element) to give a positive image.

In color diffusion transfer photographic materials, a light-sensitive silver halide emulsion, after imagewise exposed to light, is developed with an alkaline processing composition and, simultaneously therewith, an imagewise distributed image is formed of a color image-forming substance. At least a part of the color image-forming substance is transferred to an image-receiving layer superposed on the emulsion to give a positive image.

Thus, in both silver salt and color diffusion transfer photographic materials, development with an alkaline processing composition is employed for the purpose of image formation.

In these diffusion transfer photographic materials, however, the presence, after the formation of transfer images, of the alkaline processing composition in the system tends to result in the diffusion of undesired image-forming substances and thereby contaminating the image-receiving layer. Among attempts to overcome this drawback to obtain excellent images, the use of a layer has been proposed which contains a neutralizing agent to stop the development at a desired stage by getting a pH value lower than the one at which the image-forming substance is rendered nondiffusible. The layer is hereinafter referred to as a "neutralization layer".

The neutralization layer may be provided anywhere in diffusion transfer photographic materials, although it in general is provided between the image-receiving layer and the support therefor, between the light-sensitive layer and the support therefor, or in a processing sheet. As representatives of the neutralizing agent which can be incorporated into the neutralization layer, there have been disclosed, for example, polymeric acids or low molecular acids in U.S. Pat. Nos. 2,584,030 and 3,362,819. These polymeric acids or low molecular acids, however, have such drawbacks that they cause a distortion of the resulting image, that their capacity for neutralization, after a long storage, is reduced by the influence of moisture and temperature, and that even photographic materials containing them is deformed by such the influence. Further, the so-called yellow staining is often observed to take place in images formed.

An object of the present invention is to provide a diffusion transfer photographic material having incorporated thereinto a neutralization layer containing a novel neutralizing agent.

Another object of the invention is to provide a diffusion transfer photographic material containing a novel neutralizing agent whereby such images can be obtained that are of excellent storability, high color density and color purity, marked light stability, less staining and no distortion.

As a result of our extensive studies, we have now found that these objects can be accomplished by using neutralization layers containing neutralizing agents which comprise copolymers each containing, as monomer units, a monomer bearing at least one carboxyl group or at least one group hydrolizable into a carboxyl group and a monomer bearing at least one fluorine atom. The neutralizing agents as defined above are hereinafter referred to as the "compounds of the invention".

For the monomer unit in the compounds of the invention which unit bears at least one carboxyl group or at least one group hydrolyzable into a carboxyl group, there may be mentioned preferably the monomers of the following general formula (I):

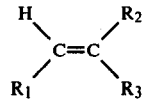

(I)

wherein $R_1$ represents hydrogen, a lower alkyl group, the group $—COOR_4$, the group

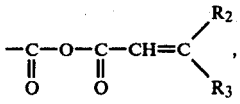

or a phenyl group which includes phenyl substituted with $—COOR_4$, or

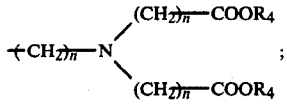

$R_2$ and $R_3$ individually stand for hydrogen, halogen, a lower alkyl group which includes alkyl substituted with $—COOR_4$, the substituted alkyl being preferably $-(CH_2)_{n-1}COOR_4$; and $R_4$ is hydrogen or a lower alkyl group in which n is an integer of 1 or 2; with the proviso that at least one of the substituents $R_1$, $R_2$ and $R_3$ which may be the same or different from each other is a carboxyl group or a group hydrolyzable into a carboxyl group, and wherein two carboxyl groups, if present, may form a cyclic anhydride.

As representatives of the monomer unit in the compounds of the invention which unit bears at least one carboxyl group or a group hydrolyzable into a carboxyl group, there may be mentioned for example ethylenically unsaturated carboxylic acids such as an acrylic acid, a methacrylic acid, an α-fluoroacrylic acid, an itaconic acid, a maleic acid, a crotonic acid, a fumaric acid, itaconic acid anhydride, maleic acid anhydride, maleic acid monoalkyl esters (such as maleic acid monoethyl or mono-n-butyl ester), citraconic acid anhydride and fumaric acid monoethyl esters.

For the monomer unit in the compounds of the invention which unit bears at least one fluorine atom, there may be mentioned preferably the monomers of the following general formula (II)

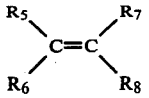

(II)

wherein $R_5$, $R_6$ and $R_7$ individually stand for hydrogen or halogen; $R_8$ represents hydrogen, halogen, or alkyl group preferably of 1 to 12 carbon atoms which group includes alkyl substituted with one or more fluorine atoms and/or with —$COOR_9$ and/or —$COR_9$, the alkyl substituted with —$COOR_9$ or —$COR_9$ being preferably $-(CH_2)_{n-1}COOR_9$ or $-(CH_2)_{n-1}COR_9$, a phenyl group which includes phenyl substituted with one or more fluorine atoms, and/or a lower alkyl group which includes alkyl substituted with one or more fluorine atoms, or a group of the general formula —O—$R_9$, —$OCOR_9$, or $$-COO-(CH_2)-\underset{\underset{R_{10}}{|}}{N}-COR_9$$

in which $R_9$ stands for hydrogen or an alkyl group preferably of 1 to 18 carbon atoms which group includes alkyl substituted with one or more fluorine atoms and alkyl of which the C—C bond(s) are interrupted by one or more oxygen atoms, $R_{10}$ represents a lower alkyl group which includes alkyl substituted by one or more fluorine atoms, n is an integer of 1 or 2; and k is an integer of 1 to 5 inclusive with the proviso that at least one of the substituents $R_5$, $R_6$, $R_7$ and $R_8$ which may be the same or different from each other is a fluorine atom or a fluorine atom-containing group.

As representatives of the monomer unit in the compounds of the invention which unit bears at least one fluorine atom there may be mentioned for example $CF_2{=}CF_2$, $CH_2{=}CF_2$, $CHF{=}CF_2$, $CH_2{=}CHF$, $CHF{=}CHF$, $CH_2{=}CF{-}CH_3$, $CH_2{=}CH{-}CF_3$, $CF_2{=}CF{-}CF_3$, $CCl_2{=}CF_2$, $CFCl{=}CH_2$, $CFCl{=}CF_2$, $CH_2{=}CH{-}CH_2(CF_2)_nH$(n=2–8),

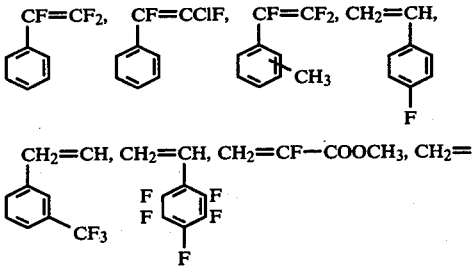

$CH_2{=}CH$, $CH_2{=}CH$, $CH_2{=}CF{-}COOCH_3$, $CH_2{=}$ $CHCOOCF_3$, $CH_2{=}CF{-}COOCH_2CH_2F$, $CH_2{=}CH{-}COOCH_2CF_2CHFCF_3$, $CH_2{=}CH{-}COOCH_2(CF_2)_3CHF_2$, $CH_2{=}CH{-}COOCH_2(CF_2)_nH$(n = 2–8),

-continued $$CH_2{=}CH{-}COOCH_2CF_2\underset{\underset{CF_3}{|}}{CHF},\ CH_2{=}\overset{\overset{CF_3}{|}}{C}{-}COOCH_3,$$

$$CH_2{=}\overset{\overset{CHF_2}{|}}{C}{-}COOC_2H_5,\ CH_2{=}\overset{\overset{CH_3}{|}}{C}{-}COOCH_2CF_3$$

$$CH_2{=}\overset{\overset{CH_3}{|}}{C}{-}COOCH_2(CF_2)_nH(n = 2\text{–}8),$$

$$CH_2{=}\overset{\overset{CH_3}{|}}{C}{-}COOCH_2CF_2CHFCF_3,$$

$CH_2{=}CHCOOCH_2CH_2OCH_2CF_3$,
$CH_2{=}CHCOOCH_2CH_2OCF_2CHF_2$,
$CH_2{=}CHCOOCH_2CF_2CF_2O(CF_2)_3CF_3$,
$CH_2{=}CHOCO(CF_2)_nF$(n = 1–8),
$CH_2{=}CHCOOCH_2CH_2OCH_2CF_2CF_2H$,
$CH_2{=}CHOCH_2CF_3$, $$CH_2{=}CHCOOCH_2CH_2\underset{\underset{C_2H_5}{|}}{N}{-}CO(CF_2)_nF(n = 1\text{–}8).$$

The compounds of the invention, i.e. the copolymers each containing, as monomer units, a monomer having at least one carboxyl group or at least one group hydrolyzable into a carboxyl group and a monomer having at least one fluorine atom may contain other monomer units in addition. In this case, the combined molar proportion, in the copolymer, of those of both, the monomer having at least one carboxyl group or at least one group hydrolyzable into a carboxyl group and the monomer having at least one fluorine atom should be 50% or higher. More preferably, the copolymers contain from 90 to 40 mol % of the former monomer having at least one carboxyl group or at least one group hydrolyzable into a carboxyl group, from 60 to 10 mol % of the latter monomer having at least one fluorine atom and from 50 to 0 mol % of other monomer units. The mode of copolymerization for obtaining the compounds of the invention is not critical; that is, the compounds of the invention prepared by any mode of copolymerization achieve the desired effect. As representatives of other monomer units in the compounds of the invention, there may be mentioned for example unsaturated aliphatic carboxylic acid vinyl esters such as vinyl acetate and vinyl butyrate; acrylates such as methyl acrylate, ethyl acrylate, n-butyl acrylate, methyl methacrylate, n-butyl methacrylate, methyl α-chloroacrylate, 2-hydroxyethyl acrylate and 2-N,N-dimethylaminoethyl acrylate; olefins such as ethylene, propylene and isobutylene; halogenated olefins such as vinyl chloride and vinylidene chloride; dienes such as butadiene and isoprene; nitriles such as acrylonitrile and methacrylonitrile; aromatic unsaturated hydrocarbons such as styrene and methylstyrene; acrylamides such as acrylamide, methacrylamide, N-methylacrylamide, N,N-dimethylacrylamide and diacetoneacrylamide; vinyl ethers such as vinyl methyl ether and vinyl ethyl ether; and N-vinylpyrrolidone.

The compounds of the invention are generally 10,000–1,000,000, preferably 15,000–100,000, in average molecular weight.

In the following are shown representative examples of the compounds of the invention, although the compounds of the invention are not intended to be limited to them:

| Exemplified Compound : (M.W values in the following mean average molecular weights:) | | |
|---|---|---|
| (1) $\left(CH_2-\underset{\underset{COOH}{\mid}}{\overset{CH_3}{\overset{\mid}{C}}}\right)_l$ | $\left(CF_2-CF_2\right)_m$ | l : m = 60 : 40 (M.W. = 30,000) |
| (2) 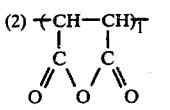 | $\left(CH_2-\underset{\underset{OCOC_3F_7}{\mid}}{CH}\right)_m$ | l : m = 50 : 50 (M.W. = 38,000) |
| (3) $\left(CH_2-\underset{\underset{CH_2COOH}{\mid}}{\overset{COOH}{\overset{\mid}{C}}}\right)_l$ | $\left(CH_2-\underset{\underset{COOCH_2(CF_2CF_2)_2H}{\mid}}{\overset{CH_3}{\overset{\mid}{C}}}\right)_m$ | l : m = 70 : 30 (M.W. = 20,000) |
| (4) $\left(CH_2-\underset{\underset{COOH}{\mid}}{CH}\right)_l$ | $\left(CH_2-\underset{\underset{OCOC_3F_7}{\mid}}{CH}\right)_m$ | l : m = 65 : 35 (M.W. = 35,000) |
| (5) $\left(\underset{\underset{COOH}{\mid}}{CH}-\underset{\underset{COOH}{\mid}}{CH}\right)_l$ | $\left(CH_2-\underset{\underset{COOCH_2CH_2OCH_2CF_2CF_2H}{\mid}}{CH}\right)_m$ | l : m = 40 : 60 (M.W. = 32,000) |
| (6) $\left(CH_2-\underset{\underset{COOH}{\mid}}{CH}\right)_l$ | $\left(CH_2-\underset{\underset{COOCH_2CH_2CH_2\underset{\underset{C_2H_5}{\mid}}{N}CO(CF_2)_2H}{\mid}}{CH}\right)_m$ | l : m = 75 : 25 (M.W. = 45,000) |
| (7) $\left(CH_2-\underset{\underset{COOH}{\mid}}{\overset{CH_3}{\overset{\mid}{C}}}\right)_l$ | $\left(CH_2-\underset{\underset{COOCH_2CF_2CHFCF_3}{\mid}}{\overset{CH_3}{\overset{\mid}{C}}}\right)_m$ | l : m = 65 : 35 (M.W. = 60,000) |
| (8) 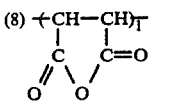 | $\left(CH_2-\underset{\underset{OCH_2(CF_2CF_2)_2H}{\mid}}{CH}\right)_m$ | l : m = 45 : 55 (M.W. = 22,000) |
| (9) 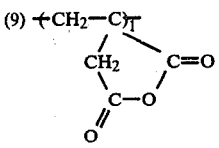 | $\left(CH_2-\underset{\underset{CF_3}{\mid}}{CH}\right)_m$ | l : m = 40 : 60 (M.W. = 30,000) |
| (10) 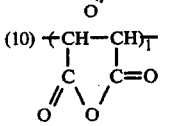 | $\left(CH_2-\underset{\underset{COOCH_2(CF_2CF_2)_2H}{\mid}}{\overset{CH_3}{\overset{\mid}{C}}}\right)_m$ | l : m = 35 : 65 (M.W. = 70,000) |
| (11) $\left(\underset{\underset{COOH}{\mid}}{CH}-\underset{\underset{COOH}{\mid}}{CH}\right)_l$ | $\left(CH_2-\underset{\underset{OCOC_3F_7}{\mid}}{CH}\right)_m$ | l : m = 50 : 50 (M.W. = 18,000) |
| (12) $\left(CH_2-\underset{\underset{COOH}{\mid}}{\overset{CH_3}{\overset{\mid}{C}}}\right)_l$ | $\left(CH_2-\underset{\underset{COOCH_2(CF_2CF_2)_3H}{\mid}}{CH}\right)_m$ | $\left(CH_2-\underset{\underset{CO-N\left(\begin{smallmatrix}CH_3\\CH_3\end{smallmatrix}\right)}{\mid}}{CH}\right)_n$ l : m : n = 45 : 25 : 30 (M.W. = 40,000) |
| (13) $\left(CH_2-\underset{\underset{COOH}{\mid}}{CH}\right)_l$ | $\left(CH_2-\underset{\underset{CF_3}{\mid}}{CH}\right)_m$ | l : m = 70 : 30 (M.W. = 50,000) |
| (14) $\left(CH_2-\underset{\underset{COOH}{\mid}}{CH}\right)_l$ | $\left(CF_2-CF_2\right)_m$ | l : m = 60 : 40 (M.W. = 33,000) |
| (15) 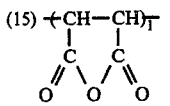 | $\left(CH_2-\underset{\underset{COOCH_2CH_2OCH_2CF_2CF_2H}{\mid}}{CH}\right)_m$ | l : m = 40 : 60 (M.W. = 25,000) |
| (16) $\left(\underset{\underset{COOH}{\mid}}{CH}-\underset{\underset{COOH}{\mid}}{CH}\right)_l$ | $\left(CH_2-\underset{\underset{CF_3}{\mid}}{CH}\right)_m$ | l : m = 40 : 60 (M.W. = 35,000) |
| (17) $\left(CH_2-\underset{\underset{COOH}{\mid}}{\overset{CH_3}{\overset{\mid}{C}}}\right)_l$ | $\left(CH_2-\underset{\underset{CH_2CF_2CF_2H}{\mid}}{CH}\right)_m$ | l : m = 65 : 35 (M.W. = 20,000) |

-continued

| Exemplified Compound : (M.W values in the following mean average molecular weights:) | | |
|---|---|---|
| (18) $\text{-}(CH_2-CH)_l\text{-}$ 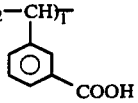 | $\text{-}(CH_2-C(CH_3))_m\text{-}$ $COOCH_2CF_2CF_2H$ | $\text{-}(CH_2-CH)_n\text{-}$ $OCOCH_3$ 1 : m : n = 60 : 35 : 5 (M.W. = 24,000) |
| (19) $\text{-}(CH_2-CH)_l\text{-}$ $COOH$ | $\text{-}(CH_2-C(CH_3))_m\text{-}$ $COOCH_2(CF_2CF_2)_3H$ | $\text{-}(CH_2-CH)_n\text{-}$ $CO-N(CH_3)_2$ 1 : m : n = 45 : (M.W. = 43,000) 30 |
| (20) $\text{-}(CH_2-C(CH_3))_l\text{-}$ $COOH$ | $\text{-}(CH_2-CH)_m\text{-}$ 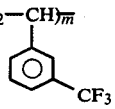 | 1 : m = 70 : 30 (M.W. = 32,000) |
| (21) $\text{-}(CH-CH)_l\text{-}$ $COOH$ $COOH$ | $\text{-}(CH_2-CH)_m\text{-}$ $OCH_2(CF_2CF_2)_2H$ | 1 : m = 45 : 55 (M.W. = 20,000) |
| (22) $\text{-}(CH-CH)_l\text{-}$ $COOH$ $COOH$ | $\text{-}(CH_2-CH)_m\text{-}$ $COOCH_2(CF_2CF_2)_2H$ | $\text{-}(CH_2-CH)_n\text{-}$ 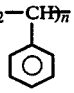 1 : m : n = 40 : 30 : 30 (M.W. = 27,000) |
| (23) $\text{-}(CH_2-CH)_l\text{-}$ $COOH$ | $\text{-}(CH_2-CH)_m\text{-}$ $COOCH_2(CF_2CF_2)_2H$ | 1 : m = 70 : 30 (M.W. = 80,000) |
| (24) 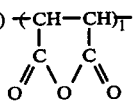 | $\text{-}(CH_2-CH)_m\text{-}$ 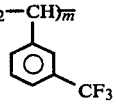 | 1 : m = 40 : 60 (M.W. = 50,000) |
| (25) $\text{-}(CH_2-CH)_l\text{-}$ $COOH$ | $\text{-}(CH_2-CH)_m\text{-}$ $CH_2CF_2CF_2H$ | 1 : m = 65 : 35 (M.W. = 30,000) |
| (26) $\text{-}(CH_2-C(CH_3))_l\text{-}$ $COOH$ | $\text{-}(CH_2-CH)_m\text{-}$ $COOCH_2(CF_2CF_2)_2H$ | $\text{-}(CH_2-CH)_n\text{-}$ 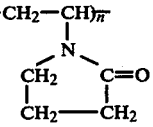 1 : m : n = 40 : 30 : 30 (M.W. = 26,000) |
| (27) $\text{-}(CH_2-CH)_l\text{-}$ 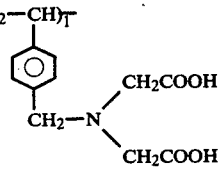 | $\text{-}(CH_2-C(CH_3))_m\text{-}$ $COOCH_2(CF_2CF_2)_2H$ | 1 : m = 50 : 50 (M.W. = 35,000) |
| (28) $\text{-}(CH_2-CH)_l\text{-}$ $COOH$ | $\text{-}(CH_2-CH)_m\text{-}$ 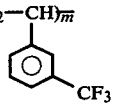 | $\text{-}(CH_2-CH)_n\text{-}$ 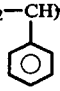 1 : m : n = 60 : 20 : 20 (M.W. = 32,000) |
| (29) 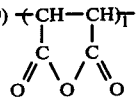 | $\text{-}(CH_2-CH)_m\text{-}$ $COOCH_2(CF_2CF_2)_2H$ | $\text{-}(CH_2-CH)_n\text{-}$ 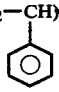 1 : m : n = 40 : 30 : 30 (M.W. = 21,000) |
| (30) $\text{-}(CH_2-CH)_l\text{-}$ $COOH$ | $\text{-}(CH_2-CH)_m\text{-}$ $OCOC_7F_{15}$ | 1 : m = 70 : 30 (M.W. = 35,000) |
| (31) 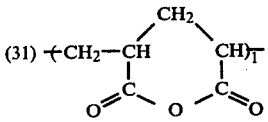 | $\text{-}(CH_2-CH)_m\text{-}$ $OCOCF_3$ | 1 : m = 40 : 60 (M.W. = 24,000) |

-continued

| Exemplified Compound : (M.W values in the following mean average molecular weights:) | | |
|---|---|---|
| (32) $\leftarrow CH(COOH)-CH(COOH)\rightarrow_l$ | $\leftarrow CH_2-C(CH_3)(COOCH_2(CF_2CF_2)_2H)\rightarrow_m$ | l : m = 35 : 65 (M.W. = 63,000) |
| (33) $\leftarrow CH_2-CH(COOH)\rightarrow_l$ | $\leftarrow CH_2-CH(COOCH_2(CF_2CF_2)_2H)\rightarrow_m$ | $\leftarrow CH_2-CH(N(CH_2-CH_2)C=O)\rightarrow_n$ l : m : n = 40 : 30 : 30 (M.W. = 48,000) |
| (34) $\leftarrow CH_2-C(CH_3)(COOH)\rightarrow_l$ | $\leftarrow CH_2-CH(OCOC_7F_{15})\rightarrow_m$ | $\leftarrow CH_2-CH(OCOCH_3)\rightarrow_n$ l : m : n = 70 : 20 : 10 (M.W. = 27,000) |
| (35) $\leftarrow CH_2-CH(COOH)\rightarrow_l$ | $\leftarrow CH_2-CH(COOCH_2CF_2CHFCF_3)\rightarrow_m$ | l : m = 60 : 40 (M.W. = 15,000) |
| (36) $\leftarrow CH_2-CH(COOH)\rightarrow_l$ | $\leftarrow CH_2-CH(COOCH_2CF_2CHF(CF_3))\rightarrow_m$ | $\leftarrow CH_2-CH(C=O(NH(CH_3-C(CH_3)-CH_2COCH_3)))\rightarrow$ l : m : n = 50 : 30 : 20 (M.W. = 40,000) |

The compounds of the invention may be prepared for example by such methods as described in W. R. Sorenson and T. W. Campbell, "Preparative Methods of Polymer Chemistry", John Wiley & Sons, Inc., New York, 1961, and C. E. Schildknecht, "Vinyl and Related Polymers", John Wiley & Sons, Inc., New York, 1952, employing appropriate modes of polymerization such as bulk, solution, suspension or emulsion polymerization under proper conditions. Typical synthetic examples for some of the compounds of the invention are shown in the following:

Synthetic Example 1

Synthesis of Compound (2)

A polymerization autoclave is charged with the mixture of 9.8 g of maleic anhydride, 24.0 g of vinyl perfluorobutyrate and 50 ml of dioxane, and 0.5 g of di-tert-butyl peroxide as a polymerization initiator is further added to the mixture. The polymerization is carried out for 25 hours while keeping the mixture at 70° C. After the reaction, the reaction mixture is concentrated, washed with n-hexane and dried under reduced pressure. 29 g of a polymer soluble in acetone and in dioxane is obtained. The specific viscosity at 30° C. of a 1% solution of the polymer in acetone is 2.4.

Synthetic Example 2

Synthesis of Compound (7)

A polymerization autoclave is charged with 11.2 g of a methacrylic acid, 17.4 g of 1,1,3-trihydro-perfluorobutyl methacrylate and 40 ml of dioxane, and 0.1 g of azobisisobutyronitrile as a polymerization initiator is added into the mixture. The polymerization is carried out for 22 hours while keeping the mixture at 70° C. After the reaction, the reaction mixture is concentrated, washed with n-hexane and dried under reduced pressure. 26 g of a polymer soluble in acetone and in dioxane is obtained. The specific viscosity at 30° C. of a 1% solution of the polymer in acetone is 3.1.

The compounds of the invention, due to the content of fluorine atom(s) in the molecule, exhibit moderate water-repellence and make it possible to produce diffusion transfer photographic materials in which diffusion transfer images can be obtained which exhibit excellent storability, high color density and purity, no staining and no generation of static electricity.

Although they themselves have a sufficient film-forming property for the purpose of the invention and hence they can be used without other binders, the compounds of the invention may be employed in combination with any binder for the formation of the neutralization layer, so far as the binder is compatible with the compounds of the invention. As representatives of the binder usable in combination with the compounds of the invention, there may be mentioned for example natural high molecular compounds such as casein, gelatin or gelatin derivatives obtained by modification with acylating agents, synthetic high molecular compounds such as polyvinyl alcohol, hydroxyethyl, cellulose, hydroxypropyl cellulose, methyl cellulose, ethyl cellulose, cellulose acetate, polyvinyl acetate, partial hydrolyzate of polyvinyl acetate, polyvinyl pyrrolidone, polymethyl methacrylate, polyethyl methacrylate, polybutyl acrylate, polyethyl acrylate, polyacrylamide, polymethacrylamide, polydiacetoneacrylamide, ethylene-vinyl acetate copolymer and vinyl chloride-vinyl acetate copolymer, and mixtures of these compounds.

The neutralization layer in accordance with the present invention may be provided anywhere in the diffusion transfer photographic material, so far as its neutralization function and formation of diffusion transfer images are not interferred with. However, it preferably is provided between an image-receiving layer and the support therefor as disclosed in U.S. Pat. Nos.

3,415,644, 3,415,645, 3,415,646 and 3,473,925; between a light-sensitive layer and the support therefor as disclosed in U.S. Pat. Nos. 3,573,043 and 3,573,042; in a processing sheet or between an image-receiving layer and the support therefor as disclosed in U.S. Pat. Nos. 3,594,164 and 3,594,165. Further, when a diffusion transfer photographic material has the layer structure of the type as disclosed in U.S. Pat. No. 3,615,421, the neutralization layer may be incorporated between a light-sensitive layer and the support therefor and/or between an image-receiving layer and the support therefor. Moreover, when the material has the layer structure suitable for peeling off as disclosed in Japanese Laid-Open-to-Public Patent Application No. 3480/1972, the neutralization layer may be incorporated between an image-receiving layer and the support therefor.

It is desirable that the neutralization layer in accordance with the invention is spaced apart from a layer, in which a processing agent is to be spread, through an intermediate layer (also called a timing layer). This intermediate layer serves to prevent the pH value of the processing composition from being lowered by the action of the neutralization layer at a too early stage, in other words, before the development of the silver halide emulsion layer, so that the formation of the diffusion transfer image takes place in the desired manner. Thus, the intermediate layer so acts as to delay the pH lowering until the desired development and transfer are finished. As materials for the intermediate layer, there may be used for example, gelatin; polyvinyl alcohol, partially acetalized polyvinyl alcohol and partially hydrolyzed polyvinyl acetate as disclosed in U.S. Pat. No. 3,362,819; cyanoethylated polyvinyl alcohol as disclosed in U.S. Pat. No. 3,419,389; hydroxypropyl methyl cellulose and isopropyl cellulose as disclosed in U.S. Pat. No. 3,433,633; such polyvinylamides as disclosed in Japanese Patent Publication No. 12,676/1971; such polyvinylamide graft copolymers as disclosed in Japanese Laid-Open-to-Public Patent Application No. 41,214/1973; and such combinations of latices and permeating agents as disclosed in Japanese Laid-Open-to-Public Patent Applications Nos. 22,935/1974 and 91,642/1974. It is also possible to cure the aforementioned polymers used as a timing layer by subjecting them to a cross-linking reaction with aldehydes such as formaldehyde, N-methylol compounds, epoxy compounds or the like.

Referring now to a light-sensitive element which can be used in the diffusion transfer photographic material using one or more of the compounds of the invention, the element for use in the silver salt diffusion transfer photographic material comprises a silver halide emulsion, and that for use in the color diffusion transfer photographic material comprises a silver halide emulsion and a color image-forming substance. The light-sensitive element as defined above is hereinafter referred to as the "light-sensitive element of the invention" and the diffusion transfer photographic material as defined above as the "diffusion transfer photographic material of the invention".

The silver halide emulsion is a hydrophilic colloidal dispersion of silver halide such as silver bromide, silver iodide, silver chloride, silver iodobromide, silver chlorobromide, silver chloroiodide, silver chloroiodobromide and their mixtures. It may be an emulsion of conventional type or one of those emulsion prepared by various processes, for example, any of the processes for preparing the so-called double jet emulsions, conversion emulsions, Lippmann's emulsions, such direct positive emulsions previously fogged as disclosed in U.S. Pat. Nos. 2,184,013, 2,456,953, 2,541,472, 2,563,785, 2,861,885 and 3,367,778, British Pat. No. 723,019 and French Pat. No. 1,520,821, and the like. Grain size, content and mixing ratio of the silver halides are selected within a wide range according to the kind of a diffusion transfer photographic material to be used. As a hydrophilic protective colloid which is a dispersant for the silver halide, there may be used various natural or synthethized colloid substances, either alone or in combination, such as gelatin, gelatin derivatives, polyvinyl alcohol and the like. Such silver halide as explained above can be chemically sensitized by the use of active gelatin; such sulfur sensitizers as allylthiocarbamide, thiourea, cystine and the like; selenium sensitizers; such noble metal sensitizers as gold sensitizer, ruthenium, rhodium and irridium sensitizers, which sensitizers may be used either singly or in appropriate combination. The silver halide may also be chemically sensitized in the manner as described in U.S. Pat. Nos. 1,623,499, 2,399,083, 3,297,446 and 3,297,447. Further, the silver halide emulsion may be otically sensitized, for example, by the use of such cyanine or merocyanine dyes as disclosed in U.S. Pat. Nos. 2,526,632, 2,503,776, 2,493,748 and 3,384,486. In general, diffusion transfer photographic materials are prepared from three kinds of silver halide emulsions having their respective light-sensitive wavelength regions different from each other.

The silver halide emulsion may also be stabilized by the use of triazoles, tetrazoles, imidazoles, azaindenes, quaternary benzothiazolium compounds, zinc or cadmium compounds, such as those disclosed for example in U.S. Pat. Nos. 2,131,038, 2,403,927, 2,566,263, 2,597,915, 2,694,716, 2,444,605, 2,728,663, 2,839,405, 2,886,437, 3,220,839, 3,236,652, 3,266,897, 3,287,135 and 3,397,987 and British Pat. No. 623,448. The emulsion may also contain a sensitizing compound of quaternary ammonium salt, polyethylene glycol or thioether type. The emulsion may also contain such sensitizing compounds as disclosed in U.S. Pat. Nos. 2,886,437, 2,944,900, 3,046,132 and 3,294,540. The emulsion may further contain suitable plasticizers for gelatin, for example glycerin; dihydroxyalkanes such as 1,5-pentanediol; esters of ethylenebisglycolic acid; bisethoxydiethylene glycolsuccinate; amides of such acids as acrylic acid; or latices. It may also contain gelatin-hardeners such as formaldehyde; halogen-substituted fatty acids such as mucobromic acid; compounds having acid anhydride groups; dicarboxylic acid chlorides; diesters of methanesulfonic acid; sodium bisulfite derivatives of dialdehydes in which the aldehydo groups are spaced apart from each other by 2 to 3 carbon atoms; N-methylol compounds; methylol compounds; epoxy compounds; and aziridine compounds. Further, the emulsion may contain various additives for photographic purposes, for example, a wetting agent such as saponin or a coating aid such as a sulfosuccinate. Still further, the emulsion may contain, if necessary, various additives commonly used in the art of photography, such as antifoggants, ultraviolet absorbers or the like. In addition, the silver halide emulsion may contain an additive for the purpose of supersensitization, for example, ascorbic acid derivatives which do not absorb visible light; azaindene compounds; cadmium compounds; and organic sulfonic acid compounds such as those described in U.S. Pat. Nos. 2,933,390 and 2,937,089.

In the silver salt diffusion transfer photography applied to the diffusion transfer photographic materials of the invention, the silver halide in the exposed area is reduced, under the action of the alkaline processing composition, into metallic silver, while the silver halide in the unexposed area is converted into a diffusible silver complex salt by the action of a silver halide solvent or a silver complex salt-forming agent, for example, thiosulfates such as sodium thiosulfate and ammonium thiosulfate, thiocyanides such as sodium thiocyanide and potassium thiocyanide; thioureas; and ammonia, and diffuses in this form.

In the color image-forming method applied to the diffusion transfer photographic material of the invention, there may be employed various practical modes which may be diversified from each other according to the manner of releasing a diffusible dye from a color image-forming substance at the time of development of silver halide. Thus, the color image-forming substance may previously contain a chromophore moiety which is prefect per se as a dye moiety, or the substance may contain a moiety which is to be turned into a chromophore moiety at the time of development and/or at any subsequent stage, or necessary components for color formation may be transferred to an image receiving layer where a dye is formed. A first mode, typical of the modes in which a dye is formed in the course of development and/or any subsequent stage, is the so-called dye developer method. The dye developer which is used in the method is a compound containing in the molecule both a chromophore moiety and a moiety having a silver halide developing function. In this method, the dye developer is used as a color image-forming substance and, as a result of oxidation of the dye developer during development of a silver halide image in an alkaline processing composition, the dye developer is turned into a diffusible dye in the composition. The thus oxidized dye developer exhibits lower solubility and diffusibility in the processing composition than the original dye developer, and is fixed in the vicinity of the reduced silver halide. The dye developer preferably is substantially insoluble in acid or neutral aqueous media, but contains at least one radical having such a degree of dessociation that the dye developer becomes soluble and diffusible in alkaline processing compositions. Such a dye developer may be incorporated into a light-sensitive element, in particular into the silver halide emulsion layer or a layer adjacent thereto, and can be used in the form of a negative element comprising a combination of a silver halide emulsion and the dye developer having a spectral absorption property corresponding to the light-sensitive wavelength region of the emulsion. By diffusion transfer from a negative element having at least one thus combined light-sensitive unit to an image-receiving element, it becomes possible to obtain a monochromatic or multicolor positive transfer image in a single development processing. Diffusion transfer photographic materials suitable for use in the first mode are disclosed in many patents, for example, British Pat. No. 804,971. As representatives of the dye developer, there may be mentioned for example those disclosed in U.S. Pat. Nos. 2,983,606, 3,135,605, 3,218,164, 3,255,001, 3,345,163, 3,415,644, 3,421,892, 3,453,107, 3,482,972, 3,551,406, 3,563,739, 3,594,165, and 3,597,200. In the present invention, furthermore, there may be used also hydrolyzable dye developers obtained by introducing hydrolyzable groups into usual developers or shorter-wavelength-shift dye developers. As representatives of these dye developers there may be mentioned for example those compounds disclosed in U.S. Pat. Nos. 3,196,014, 3,230,082, 3,230,083, 3,230,084, 3,230,085, 3,295,973, 3,307,947, 3,312,682, 3,329,670, 3,336,287, 3,579,334 and 3,826,801 and Japanese Patent Publications Nos. 379/1961, 12,393/1961 and 2,241/1962. Further, in the present invention, there may be advantageously used leuco dye developers obtained by temporarily converting the chromophore moiety of a usual dye developer into a leuco form by means of reduction. As representatives of the leuco dye developer, there may be mentioned for example those compounds disclosed in U.S. Pat. Nos. 2,892,710, 2,909,430, 2,992,105 and 3,320,063 and Japanese Laid-Open-to-Public Patent Applications Nos. 66,440/1973, 66,441/1973 and 91,324/1975.

A second mode, also typical of the aforementioned various methods, is a process in which the oxidized product of a developing agent formed during development of a silver halide reacts with a color image-forming substance thereby to release a diffusible dye. The process, more particularly, can be classified into three different types A, B and C. In the method of type A is used a non-diffusible substance which is capable of coupling with the oxidized product of a developing agent (the so-called diffusible dye-releasing coupler). Thus, as a result of the coupling reaction, a dye is split off and released which is soluble and diffusible in the alkaline processing composition. The diffusible dye-releasing coupler of the type described above may be the so-called two-equivalent-type coupler which is substituted, at the site of coupling reaction, by a radical which can be split off by the oxidized product of a developing agent. The electron conjugated system in the released dye may be previously incorporated into the coupler or may be formed in the course of the coupling reaction. The coupler of the former type exhibit a spectral absorption property close to that of the released dye. On the other hand, the coupler of the latter type, in principle, has no direct relationship in spectral absorption with the released dye, and it may be a colorless compound or a colored compound. As representatives of the diffusible dye-releasing coupler usable in the method of type A there may be mentioned for example those disclosed in U.S. Pat. Nos. 3,227,550, 3,765,886 and 3,880,658, British Pat. Nos. 840,731, 904,364, 904,365 and 1,038,331.

In the method of type B is brought about a condensation reaction between an oxidized product of a developing agent and a diffusible dye-releasing coupler. Subsequently to the condensation reaction, an intramolecular ring-closure reaction takes place between the site of reaction and the substituent in the adjacent position thereto in the coupler, with the result that the dye residue contained in the substituent is split off thereby to release a diffusible dye. Thus, for example, an aromatic primary amino developing agent is linked, through an oxidative coupling reaction, to the 4-position of the phenol or aniline nucleus, and subsequently thereto, reacts with the sulfonamido group containing a chromophore moiety in the 3-position of the phenol or aniline nucleus, thus forming an azine ring thereby to release a diffusible dye having a sulfinic acid residue. As representatives of the diffusible dye-releasing coupler usable in the method of type B, there may be mentioned for example those disclosed in U.S. Pat. Nos. 3,443,940 and 3,734,726 and Japanese Patent Publication No. 32,129/1973.

In the method of type C, a color-image-forming substance is oxidized by the oxidized product of an auxiliary agent formed upon development to undergo a ring closure reaction, or to undergo a cleavage reaction, thereby releasing, in either case, a diffusible dye. As representatives of the auxiliary agent which causes the ring closure reaction to occur through oxidation, there may be mentioned for example hydroquinones and 3-pyrazolidones. As representatives of the color image-forming substance usable in the method of this type there may be mentioned for example those disclosed in U.S. Pat. Nos. 3,245,789, 3,443,939, 3,443,940, 3,698,897, 3,725,062, 3,728,113 and 3,880,658, Belgian Pat. Nos. 796,041 and 796,042 and Japanese Laid-Open-to-Public Patent Applications Nos. 33,826/1973 and 114,424/1974.

A third typical mode is a process in which a color image-forming substance is used, which substance releases a diffusible dye upon its cleavage in an alkaline solution, but in which the cleavage does not substantially take place when an oxidized developing agent is present in the system. Specific examples of such a color image-forming substance are disclosed for example in Japanese Laid-Open-to-Public Patent Application No. 111,628/1974.

As a chromophore moiety in the above-mentioned different types of color image-forming substances, there may be used various materials such as azo dyes, azomethine dyes, anthraquinone dyes, azine dyes and indophenol dyes. In addition thereto, there may also be used such leuco dyes which are precursors of these dyes mentioned above, for example, as Japanese Laid-Open-to-Public Patent Applications Nos. 66,440/1973 and 111,628/1974; such shift type dyes, the auxochrome groups of which have been acylated, as disclosed in Japanese Patent Publication No. 12,393/1961 and Japanese Laid-Open-to-Public Patent Applications Nos. 111,628/1974 and 115,528/1975; such diazonium compounds as disclosed in Japanese Laid-Open-to-Public Patent Application No. 10,035/1975; and couplers capable of forming dyes on reaction with the oxidation products of color developing agents.

In the case of the first and third modes, development processing by the use of negative-type silver halide emulsions gives positive diffusion transfer images. In the case of the second mode, on the other hand, development processing by the use of negative type silver halide emulsions gives negative diffusion transfer images. Therefore, a reversing operation becomes necessary in the second mode. For this reason, there are used in this case, for example, direct positive emulsions, that is, such emulsions of internal latent image type as disclosed in U.S. Pat. Nos. 2,588,982, 2,592,550 and 3,227,552 and such emulsions which have previously been fogged as disclosed in British Pat. Nos. 443,245 and 462,730 and U.S. Pat. Nos. 2,005,837, 2,541,472 and 3,367,778. It is also possible to process, with a silver halide solvent-containing developer, a layer containing a diffusible dye-releasing coupler and physical development nuclei which layer is provided adjacent to the negative type silver halide emulsion layer. Specific examples of such development processing are disclosed for example in U.S. Pat. Nos. 3,243,294 and 3,630,731. Furthermore, it is also possible to provide a layer containing both a diffusible dye-releasing coupler and a spontaneously reducible metal salt, adjacent to a negative type silver halide emulsion layer which contains a compound capable of releasing, by reaction with the oxidation product of a developing agent, a development inhibitor such as 1-phenyl-5-mercaptotetrazole (the so-called DIR substance). Specific examples of such a mode are disclosed for example in U.S. Pat. Nos. 3,148,062, 3,227,551, 3,227,554, 3,364,022 and 3,701,783 and Japanese Patent Publications Nos. 21,778/1968 and 49,611/1972. In the present invention, there may be used any combination of negative type silver halide emulsions and color image-forming substances, and there may also be employed any mode of giving negative or positive color images.

The color image-forming substance used in the present invention may be dispersed, in various ways in accordance with the type of the color image-forming substance, in a hydrophilic protective colloid such as gelatin or polyvinyl alcohol which is a corrier for the silver halide emulsion layers or layers adjacent thereto in the light-sensitive element.

Thus, for example, the color image-forming substance used in the present invention is dissolved in an organic solvent used in an amount as small as possible, and the resulting solution is then dispersed in a hydrophilic protective colloid such as gelatin or polyvinyl alcohol which is a carrier for the silver halide emulsion layers or layers adjacent thereto in the light-sensitive element. As the organic solvent for the color-image forming substance, there may be used, either singly or in combination, a high boiling solvent, a low boiling solvent removable by evaporation from the dispersion or a solvent readily miscible with water.

As particularly useful high boiling solvents in the present invention, there may be mentioned N-n-butylacetanilide, diethyllaurylamide, dibutyllaurylamide, dibutyl phthalate, tricresyl phosphate and the like. Useful as low boiling solvents are ethyl acetate, methyl acetate, 4-methylcyclohexanone and the like, and these low boiling solvents may be removed by evaporation at the time of drying after coating layers containing the same, or may be removed, prior to coating, in the manner as described in U.S. Pat. No. 2,801,171. As examples of the organic solvent readily miscible with water there may be mentioned 2-methoxyethanol, dimethylformamide and the like, and these solvents can be removed in the manner as described in U.S. Pat. No. 3,396,027. Various oleophilic polymers may also be usable either in place of or in combination with the high boiling solvents. As such oleophilic polymers as described above there may be used for example polyvinyl acetate, polyacrylates and polyesters obtained from polyhydric alcohols and polybasic acids.

Such methods as disclosed in Japanese Patent Publications 13,837/1968 and 32,131/1973, Japanese Laid-Open-to-Public Patent Application No. 17,637/1975 and U.S. Pat. No. 3,832,173 are useful for the dispersion of color image-forming substances used in the present invention. In the case of color image-forming substances having such water-solubilizing groups as carboxyl or sulfo, the substance is first dissolved in water or in an alkaline aqueous solution and the resulting is dispersed in a hydrophilic protective colloid and, if necessary, the resulting dispersion may be neutralized before use.

Further, it is also possible directly to disperse the color image-forming substance used in the present invention, without the use of high boiling solvents or the like, in such a hydrophilic protective colloid as disclosed in Japanese Patent Publication No. 32,131/1973 and U.S. Pat. No. 3,832,173.

The amount of the color image-forming substance used in the present invention may be varied within a wide range according to the kind of a compound to be used and the desired results. However, the color image-forming substance is preferably used, for example, in an amount of about 0.5 to about 10% by weight based on the weight of a water-soluble organic colloid coating liquid to be coated.

In addition, for the purpose of stabilizing the dispersed color image-forming substance, such sulfites as disclosed in U.S. Pat. No. 3,287,133 may be incorporated into the dispersion.

When it is desired to carry out the tricolor photographic process, intermediate layers are advantageously used in the light-sensitive element. The intermediate layer may be made up of gelatin, gelatin derivativs and/or hydrophilic polymers such as polyacrylamide, partially hydrolyzed polyvinyl acetate or hydroxypropylcellulose. It may also be a porous layer formed from a latex of a hydrophilic polymer and a hydrophobic polymer as disclosed in U.S. Pat. No. 3,625,685. In order to prevent color mixing caused by diffusion of an oxidized product of a developing agent from one layer (wherein the developing agent is oxidized) into other layers, the intermediate layers are preferably incorporated with couplers, such amidrazone compounds as disclosed in Japanese Laid-Open-to-Public Patent Application No. 15,531/1973, such hydrazone compounds as disclosed in West German Pat. No. 2,123,268 or the so-called layer interaction-inhibiting agents.

As a support for the light-sensitive element of the present invention, there may be used various materials, for example, paper, glass or films of natural or synthetic polymers such as cellulose nitrate, cellulose acetate, polyvinyl acetal, polystyrene, polyethylene terephthalate, polypropylene or polyethylene, and these materials may be either transparent or opaque according to the end use thereof. In addition, such supports capable of permeating water vapor as disclosed in U.S. Pat. No. 3,573,044 or supports capable of shutting oxygen can be advantageously used as those for the light-sensitive element of the present invention. In case of a light-sensitive element comprising a transparent support, the transparent support may be colored to such an extent that the silver halide emulsion layer on the support may be prevented during the course of processing from light fog which otherwise would be caused by piping of light rays in the support through the edge portion of the support, but that the colored support may not hinder exposure to light of the light-sensitive element and observation of the image formed.

The light-sensitive element as fully described in the foregoing is preferably laid on the top of an image-receiving element as will be described hereinafter, and is generally processed by spreading an alkaline processing composition as will be mentioned later between the two elements. When, in a color diffusion transfer photographic material, a dye developer is used as a color image-forming substance, there occurs reduction of the silver halide as well as oxidation of the dye developer in the exposed area upon application of an alkaline processing composition, and the oxidized dye developer, due to its low diffusibility in the alkaline processing composition, remains immobilized in the proximity of the reduced silver halide. On the other hand, the unoxidized dye developer is in general insoluble in neutral aqueous solutions, and is soluble and diffusible in the alkaline processing composition. As a consequence, the dye developer in the unexposed area comes to act, per se, as diffusible dye when the alkaline processing composition is applied thereto. (Accordingly, ther term "diffusible dye" as used hereinbefore and hereinafter is defined to include diffusible dyes released or formed from color image-forming substances as well as dye developers which are diffusible in alkali.) When the above-described non-diffusible coupler capable of coupling with an oxidized developing agent is used as a color image-forming substance, a dye soluble and diffusible in an alkaline processing solution is released therefrom either as a result of the coupling reaction of the oxidized developing agent with said couple which reaction is caused to occur upon application of the alkaline processing composition, or by a ring closing reaction subsequent to the coupling reaction. Further, when a non-diffusible compound which undergoes ring closure on such oxidation as mentioned above or cleaves in an alkaline solution to release, in either case, a diffusible dye is used as a color image-forming substance, there occur reduction of silver halide as well as oxidation of said color image-forming substance in the exposed area of the light-sensitive element and the oxidized color image-forming substance releases a diffusible dye as a result of the subsequent intramolecular ring closure reaction. Alternatively, an alkaline processing composition is applied to a color image-forming substance in the presence of a silver halide developing agent thereby to oxidize said developing agent. The oxidized developing agent in turn oxidizes the color image-forming substance, and the oxidized color image-forming substance cleaves to release a diffusible dye.

In case where a color-image forming substance which undergoes cleavage in alkali to release a diffusible dye, but which does not substantially undergo such cleavage when an oxidized developing agent is present in the system, is used in a light-sensitive element, a diffusible dye is not formed in the exposed area because the oxidized developing agent resulting from reduction of a silver halide is present in the area, while, in the unexposed area, said color image-forming substance undergoes cleavage with alkali to release a diffusible dye because no oxidized developing agent is not present in said unexposed area.

The image-receiving element which is used to mordant the silver complex salt or the diffusible dye being transferred by diffusion from the light-sensitive element may be appropriately selected according to the object thereof as will be described later.

As a support for the image-receiving element, there may be used, according to the object, various materials, such as those described above as suitable for use as supports for the light-sensitive element. The support for the image-receiving element may also be either transparent or opaque.

The image-receiving element must have indispensably a layer which contains either a silver-precipitating agent or a mordant; that is, an image-receiving layer. As silver-precipitating agents or mordants suitable for use in the image-receiving layer in the image-receiving element, there may be used any silver-precipitating agents or mordants so long as they have preferable effects on the silver complex salt or the diffusible dye being diffusion transferred thereto from the light-sensitive element.

As examples of the silver-precipitating agent usable in the silver salt diffusion transfer photographic materials according to the present invention there may be mentioned such silver-precipitating agents, known per se, as, for example, sulfides, selenides, polysulfides, polyselenides, thioureas, heavy metals, heavy metal salts, stannous halides, fogged silver halides, Carey Lea silver, and complex salts of heavy salts with such compounds as thioactamide, dithiooxamide and dithiobiuret. Examples of silver-precipitating agents of the type described above and image-receiving elements containing such silver-precipitating agents are disclosed for example in U.S. Pat. Nos. 2,698,237, 2,698,238, 2,698,245, 2,774,667, 2,823,122, 3,396,018 and 3,369,901. In particularly preferred silver-precipitating agents are for example noble metals, such as silver, gold, platinum and palladium, in the form of colloid. These silver-precipitating agents may be prepared in the presence of a protein colloid and then coated on an image-receiving sheet. The silver-precipitating agents may be formed in the image-receiving layer, or may be applied by either precipitating or depositing by evaporation onto the surface of an image-receiving layer or sheet. It is also possible to incorporate, into an image-receiving layer, the above-described silver-precipitating agents in combination with such colloids or colloidal particles as those of silica, bentonite, diatomaceous earth, finely divided glass, metal oxides such as titanium oxide, colloidal alumina, finely divided aluminum oxide, zirconium oxide, or the like.

When an acid dye or an anionic dye is to be mordanted, there may be mentioned, as mordants usable in the color diffusion transfer photographic materials according to the invention, for example, such polymer of aminoguanidine derivatives of vinyl methyl ketone as disclosed in U.S. Pat. No. 3,148,061, such styrene/N-(3-maleimidopropyl)-N,N-dimethyl-N-(4-phenylbenzyl-)ammonium chloride polymer as disclosed in U.S. Pat. No. 3,709,690, such polymer containing a N-substituted maleimide unit as disclosed in U.S. Pat. No. 3,639,357, and those non-polymeric organic cationic mordants as described in U.S. Pat. Nos. 3,271,147 and 3,271,148, for example, N-laurylpyridinium bromide, cetyltrimethylammonium bromide, methyl-tri-n-laurylammonium para-toluenesulfonate, methyl-ethyl-cetyl-sulfonium iodide or benzyl-toluene-phenylphosphonium chloride. In addition to the above-described compounds, compounds containing multi-valent metals such as thorium, aluminum or zirconium, exhibit mordant action on anionic image forming substances. These mordant compounds preferably form films with the aid of film-forming compounds, for example, gelatin, gelatin derivatives such as acid-modified gelatin, polyvinyl alcohol, polyacrylamide, polyvinyl methyl ether, hydroxyethyl cellulose, N-methoxymethylpolyhexylmethyleneadipamide or polyvinylpyrrolidone. When the color image-forming substance is one of the components for color formation, such as a diffusible coupler, the image-receiving layer contains the coupling reaction partners, for example, a p-phenylenediamine derivative and an oxidizing agent or a diazonium compound which are to be reacted with said color image-forming substance to form a dye. As image-receiving elements having this type of image-receiving layers there may be used, for example, those described in U.S. Pat. Nos. 2,647,049, 2,661,293 2,698,244, 2,698,798, 2,802,735 and 3,676,124 and British Pat. Nos. 1,158,440 and 1,157,507. It is also possible, for the purpose of improving the color tone of the diffusion-transferred image, to use a color-toning agent. The color-toning agent may be incorporated into an alkaline processing composition, a silver halide emulsion or into an image-receiving layer or a layer thereon. As such color-toning agent usable in the invention, there may be mentioned, for example, 2-mercaptothiazonine, 2-amino-5-mercapto-1,3,4-thiadiazole, 2-thionoimidazolidine, 2-mercapto-5-methyloxazoline, 2-thionoimidazolineselenotetrazole and such 5-mercaptotetrazoles as disclosed in U.S. Pat. Nos. 3,295,971 and 2,699,393.

In a special case, furthermore, a mordant can be advantageously incorporated into an alkaline processing solution in the manner as described in Japanese Laid-Open-to-Public Patent Application No. 47,626/1975. The diffusible dye being transferred by diffusion to or image-receiving element may not be a dye, per se, but a leuco dye or a dye precursor. In such a case, it is advantageous that the image-receiving element is incorporated, for example, with an oxidizing agent, a color developing agent or a diazonium compound in order to convert the leuco dye or the dye precursor into the corresponding dye. Examples of image-receiving elements containing these oxidizing agents, color developing agents or diazonium compounds or the like are shown, for example in U.S. Pat. Nos. 2,647,049, 2,698,798 and 3,676,124, French Pat. Nos. 2,232,777 and 2,232,777 and Japanese Laid-Open-to-Public Patent Application No. 80,131/1975. It is also possible to use those compounds which are capable of converting the leuco dyes or dye precursors described in the patents specified above. In addition, it is also possible to employ, in the diffusion transfer photographic materials of the invention, such a method as disclosed for example in French Pat. Nos. 2,232,776 and 2,232,777 and Japanese Laid-Open-to-Public Patent Application No. 104,023/1975, in which method an oxidizing agent is made present in an alkaline processing solution.

In addition thereto, the image-receiving element may be incorporated with various additives commonly used in the art of photography, for example, ultraviolet absorbers, fluorescent brightening agents and the like.

Furthermore, it is also possible to provide intermediate layers between layers such as layers constituting a light-sensitive element or an image-receiving element, a silver halide emulsion layer, a color image-forming substance layer and a mordant layer. These intermediate layers may be incorporated with various additives commonly used in diffusion transfer photographic materials, in addition to a hydrophilic colloid such as gelatin.

The alkaline processing composition used in the present invention contains ingredients necessary for development of a silver halide emulsion and formation of a diffusible dye, and exhibits a strong alkalinity, in general of a pH value of 10 or higher. The composition contains hydroxide of alkali metals or alkaline earth metals, such as sodium hydroxide, potassium hydroxide, calcium hydroxide and lithium hydroxide, sodium carbonate, diethylamine or the like. Into the alkaline processing composition may be incorporated an antifogging agent such as benzotriazole. It is also possible to incorporate into the alkaline processing composition such an elution-accelerating agent as disclosed in Japanese Laid-Open-to-Public Patent Application No. 124,727/1975.

Furthermore, the alkaline processing composition may contain a viscosity-increasing compound, for example, a high molecular viscosity-increasing compound inert to the alkaline solution, such as hydroxyethyl cellulose or sodium carboxymethyl-cellulose. The concentration of the viscosity-increasing agent is preferably in the range of from about 1 to 5% by weight based on the weight of the alkaline processing composition. The viscosity-increasing agent used in such concentrations not only imparts a viscosity in the range of from about 100 to 200,000 centipoise to the alkaline processing composition thereby to facilitate uniform spreading of the alkaline processing composition at the time of processing, but also, in the event that the aqueous solvent is transferred, in the course of processing, to the light-sensitive element and the image-receiving element to concentrate the alkaline processing composition, forms a non-fluid film thereby to aid integration of the processed film unit. The polymer film described just above, after the formation of a diffusion transfer image has been substantially completed, also serves to prevent further transfer of the image-forming component to the image-receiving layer thereby to preclude undesired changes in the image formed. In addition thereto, the alkaline processing composition may be incorporated with a light-absorbing substance such as carbon black for the purpose of preventing the silver halide emulsion from being fogged in the course of processing under the action of external light. It is desirable in the present invention, especially in the case of a color diffusion transfer process of the dye developer type, that into the alkaline processing composition is added an onium compound such as a quaternary ammonium compound. As representatives of preferred examples of the onium compound there may be mentioned 1-benzyl-2-picolinium bromide, 1-(3-bromopropyl)-2-picolinium p-toluenesulfonate, 1-phenethyl-2-picolinium bromide, 2,4-dimethyl-1-phenethylpyridinium bromide, α-picoline-β-naphthoylmethyl bromide, N,N-diethylpiperidinium bromide, phenethyltrimethylphosphonium bromide and dodecyldimethylsulfonium p-toluene-sulfonate. In addition to the onium compounds described above, there may also be used onium compounds such as disclosed in U.S. Pat. Nos. 3,173,786 and 3,411,904.

In the aforementioned second mode of diffusion transfer process in which an oxidized product formed during development of a silver halide reacts with a non-diffusible coupler which is a color image-forming substance thereby to release a diffusible dye and to form a color image in the presence of an aromatic amine, the alkaline processing composition used therein contains such a developing agent as an aromatic primary amine. In this mode of process, such additives for alkaline processing compositions as disclosed in Japanese Patent Publication Nos. 17,184/1966 and 21,778/1968 and Japanese Laid-Open-to-Public Patent Application No. 325/1972 are useful in the present invention.

Furthermore, the alkaline processing composition may contain a light reflecting agent, for example, titanium dioxide, barium sulfate, zinc oxide, alumina, barium stearate, calcium carbonate, kaolin, magnesium oxide and the like. As method of reflecting light behind the image-receiving layer, there may be employed such methods as disclosed in Japanese Laid-Open-to-Public Patent Application Nos. 486/1971 and 447/1972. In addition to the light reflecting agent, the alkaline processing composition may contain a fluorescent brightening agent, for example, stilbene, coumarin, triazine, oxazole and the like. The processing composition may also be incorporated with an opacifying agent such as carbon black, and/or with such an indicator dye as disclosed in Japanese Laid-Open-to-Public Patent Application Nos. 26/1972, 27/1972 and 28/1972.

It is also possible to incorporate a development inhibitor such as 1-phenyl-5-mercaptotetrazole or benzylaminopurine into any one of the light-sensitive element, image-receiving element or alkaline processing composition. Furthermore, it is advantageous in the present invention to incorporate an auxiliary developing agent, for example a hydroquinone derivative such as p-tolylhydroquinone, a catechol derivative or Phenidone into any one of the light-sensitive element, image-receiving element or alkaline processing composition. Such auxiliary developing agents as disclosed in Japanese Patent Publication No. 17,383/1960, U.S. Pat. Nos. 2,939,788, 3,192,044 and 3,462,266, British Pat. No. 1,243,539 and Japanese Laid-Open-to-Public Patent Application Nos. 40,128/1974, 83,440/1974, 84,238/1974 and 6,340/1975 may be advantageously usable in the present invention. The auxiliary developing agent may be incorporated into the light-sensitive element or image-receiving element according to a procedure similar to that employed in dispersing the color image-forming substance as mentioned above. The auxiliary developing agent may also be incorporated in a homogeneous state into the image-receiving element in the manner as described in Japanese Laid-Open-to-Public Patent Application No. 131,134/1974. Furthermore, such desensitizing agents as disclosed in U.S. Pat. No. 3,579,333 may also be employed additionally.

The alkaline processing composition used in the present invention is preferably stored in a rupturable container. In a preferred embodiment, the alkaline processing composition is filled in a cavity formed by folding a sheet made up of a material which do not permit permeation of liquid and air and then sealing the edges, so that the resulting container, when the film unit passes through a pressing device, may undergo a rupture at a predetermined part thereof by the action of an internal pressure applied to the alkaline processing composition contained therein, thereby to release the contents. As materials for forming such containers there may be used for example polyethylene terephthalate/polyvinyl alcohol/polyethylene laminates, lead foil/vinyl chloride-vinyl acetate copolymer laminates and the like. The container of the type described above is preferably secured along the front edge of the film unit so that the processing composition contained therein may be spread, in a substantially single direction, over the surface of the light-sensitive element. Preferred examples of such containers are shown in U.S. Pat. Nos. 2,543,181, 2,643,886, 2,653,732, 2,723,051, 3,056,491, 3,056,492, 3,152,515 and 3,173,580.

In the present invention, application of the alkaline processing solution can be made while keeping the light-sensitive element which has been imagewise exposed to light and the image-receiving element in a superposed state. As a consequence, in a film unit used in the present invention, the light-sensitive element, before exposure to light, may be present apart from the image-receiving element, or both elements may be combined into a unit. After processing, the light-sensitive element may be kept still combined with the image-receiving element in a unit, or the two elements may be peeled off from each other. Any of such film units as disclosed in U.S. Pat. Nos. 3,415,644, 3,415,645, 3,415,646, 3,473,925, 3,573,042, 3,573,043, 3,594,164, 3,594,165 and 3,615,421 and Belgian Patents 757,959 and 757,960 may also be usable in the present invention.

In practicing the present invention, as the surface layer for the image-receiving element may be provided a hydrophilic binder layer which contains a hydrophilic colloid, such as gelatin, gelatin derivatives, starch, dextran, polyvinyl pyrrolidone, gum arabic, carboxymethyl cellulose, hydroxyethyl cellulose, polyvinyl alcohol, gual gum or acacia gum. If, after development treatment, the light-sensitive element is to be peeled off from the image-receiving element to obtain an image, then the so-called delaminating agent is used. The delaminating agent may be present on the surface of the silver halide emulsion layer or on the image-receiving layer containing either a silver-precipitating or a mordant, or may be incorporated into the processing composition. As a suitable delaminating agent is used in general a material having a different composition from that of the binder used in the silver halide emulsion layer. As such materials, there may be mentioned, for example, alkali-permeable polysaccharides, carboxymethyl cellulose, hydroxyethyl cellulose, hydroxypropyl cellulose, 4,4'-dihydroxyphenolglucose, saccharose, sorbitol, inositol, resorcinol, phytic acid sodium salt, zinc oxide, particulate polyethylene, particulate polytetrafluoroethylene, such polyvinylpyrrolidone/polyvinyl hydrogen phthalate as disclosed in U.S. Pat. No. 3,325,283 and such ethylene/maleic anhydride copolymers as disclosed in U.S. Pat. No. 3,376,137.

Each of the strata constituting the diffusion transfer photographic material of the invention can be formed by applying a coating composition in any one of different ways as will be mentioned later. In the coating composition is contained a surface active agent, for example, saponin, anionic surface active agents, such as alkylaryl-sulfonic acids of the type disclosed in U.S. Pat. No. 2,600,831 such amphoteric surface active agents as disclosed in U.S. Pat. No. 3,133,816 and such water soluble adducts of glycidol and alkylphenols as disclosed in British Pat. No. 1,022,878.

Furthermore, for the purpose of facilitating the coating operation as mentioned above, the coating composition may contain any one or more of different viscosity-increasing agents. Thus, for example, it preferably contains anionic polymers, for example acrylic acid polymers such as polyacrylamide of high molecular weight, which exhibit their viscosity-increasing activity as a result of an interaction with a polymer in the coating composition to which polymer they can be linked.

In preparing the diffusion transfer photographic material of the invention by means of coating, there may be employed different coating methods, for example, the dip coating method, the air knife method, the curtain coating method, or such an extrusion coating method with the use of a hopper as disclosed in U.S. Pat. No. 2,681,294. If desired, it is also possible simultaneously to form two or more layers by such coating methods as disclosed in U.S. Pat. No. 2,761,791 and British Pat. No. 837,095. In addition, such methods of forming silver halide emulsion layers by means of vaccum evaporation as disclosed in British Pat. No. 968,453 and U.S. Pat. No. 3,219,451 are advantageously applicable to the preparation of the diffusion transfer photographic materials of the invention.

Each of the hardenable strata constituting the diffusion transfer photographic material of the invention can be hardened with inorganic or organic hardening agents, used either singly or in appropriate combination.

As hardening agents usable in the present invention, there may be mentioned, for example, aldehydes such as formaldehyde and succinaldehyde, blocked aldehydes, ketones, carboxylic acid derivatives, carbonic acid derivatives, sulfonates, sulfonylhalides, vinylsulfones, active halogenated compounds, epoxy compounds, aziridines, active olefins, isocyanates, carbodiimides, and hardeners with mixed functions.

The present invention is illustrated below with reference to examples, but the invention is not intended to be limited thereto.

EXAMPLE 1

On a transparent polyethylene terephthalate film base having a film thickness of 100μ was coated a neutralization layer containing one of the different neutralizing agents mentioned below.

(A) 63 g of ethylene/maleic anhydride copolymer was mixed with 129 g of n-butyl alcohol and 0.2 ml of 85% phosphoric acid, and the mixture was heated under reflux for 14 hours. Thereafter 200 ml, per 100 ml of the refluxed mixture, of acetone was added to the mixture. The thus obtained coating composition was applied to the film base on that the resulting layer came to have a dry thickness of 23μ.

(B) A coating composition consisting of an acetone-/ethyl acetate solvent mixture containing 2:1, in weight ratio, of Compound (7) and polydiacetoneacrylamide was adjusted to a viscosity of 200 centipoise, and then applied to the film base so that the resulting layer came to have a dry thickness of 23μ.

(C) A coating composition consisting of an acetone-/ethyl acetate solvent mixture containing Compound (7) was adjusted to a viscosity of 200 centipoise and then applied to the film base so that the resulting layer came to have a dry thickness of 18μ.

(D) A coating composition consisting of an acetone-/ethyl acetate solvent mixture containing 2:1, in weight ratio, of Compound (11) and polymethyl methacrylate was adjusted to a viscosity of 200 centipoise and then applied to the film base so that the resulting layer came to have a dry thickness of 23μ.

(E) A coating composition consisting of an acetone-/ethyl acetate solvent mixture containing Compound (11) was adjusted to a viscosity of 200 centipoise and then applied to the film base so that the resulting layer came to have a dry thickness of 19μ.

(F) A coating composition consisting of Compound (2) dissolved in a methyl ethyl ketone/ethanol solvent mixture was applied to the film base so that the resulting layer came to have a dry thickness of 23μ.

(G) A coating composition consisting of Compound (21) dissolved in an acetone/n-butyl acetate solvent mixture was applied to the film base so that the resulting layer came to have a dry thickness of 23μ.

(H) A coating composition consisting of Compound (25) dissolved in an acetone/butyl cellosolve solvent mixture was applied to the film base so that the resulting layer came to have a dry thickness of 23μ.

(I) A coating composition consisting of Compound (34) dissolved in an acetone/cyclohexanone solvent mixture was applied to the film base so that the resulting layer came to have a dry thickness of 23μ.

(J) A coating composition consisting of Compound (36) dissolved in an acetone/cyclohexanone solvent mixture was applied to the film base so that the resulting layer came to have a dry thickness of 23μ.

Subsequently thereto, an intermediate layer was formed on each of thus obtained neutralization layers (A) through (J) by applying to the latter a latex containing 40 parts by weight of butyl acrylate/diacetone acrylamide/styrene/methacrylic acid (60/30/4/6) copolymer and 1 part by weight of polyacrylamide so that the resulting layer came to have a dry thickness of 5μ.

On top of each of the intermediate layers thus formed is coated an image-receiving layer by applying thereto a coating composition of the composition described below so that the resulting layer came to have a dry thickness of 6μ.

Formulation of coating composition for image-receiving layer:

| | |
|---|---|
| Polyvinyl alcohol | 12 g |
| Water | 340 ml |
| Poly-4-vinylpyridine | 6 g |
| Glacial acetic acid | 3 ml |
| Emalgen 108 (polyoxyethylene lauryl ether) in 2% aqueous solution | 5 ml |

Thus obtained image-receiving elements (A) through (J) containing neutralization layers (A) through (J), respectively, were allowed to stand at a temperature of 25° C. and a relative humidity of 60% for 7 days. Image-receiving element (A) showed a deformation in the coated films and became intransparent, while other image-receiving elements (B) through (J) showed neither of such phenomena.

Transmission percentages of light at 600 mμ was measured with respect to these image-receiving elements and the results are set forth in Table 1.

Table 1

| Image-receiving element | Transmission (%) |
|---|---|
| (A) | 72.3 |
| (B) | 90.5 |
| (C) | 90.0 |
| (D) | 90.3 |
| (E) | 90.1 |
| (F) | 89.0 |
| (G) | 85.4 |
| (H) | 90.0 |
| (I) | 84.2 |
| (J) | 87.0 |

As can be seen from the results shown in Table 1, image-receiving elements (B) through (J) containing the compounds of the invention exhibit higher transmission (%) than image-receiving element (A) containing a neutralizing agent other than the compounds of the invention.

EXAMPLE 2

On a baryta paper support overcoated with a cellulose acetate butyrate layer subbed with gelatin were coated in sequence the following layers to obtain a light-sensitive element.

(1) A silver iodobromide emulsion was applied so that the resulting gelatin light-sensitive layer came to have a dry thickness of 6μ and contain 1.6 g/m$^2$ of silver.

(2) Gelatin was applied at a gelatin coverage of 1.5 g/m$^2$.

The thus obtained light-sensitive element was exposed to light through optical wedge.

Separately, Solution A and Solution B of the respective compositions mentioned below were mixed together to give a coating composition. The resulting coating composition was applied to the intermediate layer in each of the image-receiving elements (A), (B), (E) and (H) prepared in Example 1 but before the coating of the image-receiving layer so that the resulting layer came to have a wet thickness of 50μ, thereby to obtain image-receiving elements (K), (L), (M) and (N), respectively.

| | | |
|---|---|---|
| Solution A | Snowtex (Colloid Silica) | 50 ml |
| | 0.1 N aqueous sodium sulfide solution | 0.5 ml |
| Solution B | 0.1 N aqueous cadmium acetate solution | 3 ml |
| | Aerosol OT (sodium di-2-ethylhexyl sulfosuccinic acid) in 1% aqueous solution | 2 ml |
| | Water | 20 ml |

The following alkaline processing composition was used:

| | |
|---|---|
| Alkaline processing composition | |
| Water | 100 ml |
| Sodium sulfite | 5.8 g |
| Carboxymethyl cellulose | 5.8 g |
| Sodium hydroxide | 2.7 g |
| Sodium thiosulfate | 3.3 g |
| Hydroquinone | 5.0 g |
| Metol | 1.8 g |
| Emasol 1130 (polyoxyethylene sorbitan alkyl ester, from Kao Soap Co., Ltd.) | 5 ml |

A processing pod in which the above-described alkaline processing composition was contained was placed between the aforementioned exposed light-sensitive element and the aforementioned image-receiving element but outside an image area. The resulting stack was pressed by means of a press roller so that the pod was ruptured so as to effect a development treatment. Sixty seconds after the development treatment at room temperature, the light-sensitive element and the image-receiving element were peeled off from each other. After the thus separated image-receiving element was allowed to stand at a temperature of 25° C. and a relative humidity of 60% for 7 days, the maximum density ($D_{max}$) and the minimum density ($D_{min}$) of the image formed on the element were measured. The results were as shown in Table II.

Table II

| Image-receiving element | $D_{max}$ | $D_{min}$ |
|---|---|---|
| (K) | 1.47 | 0.46 |
| (L) | 1.70 | 0.25 |
| (M) | 1.68 | 0.23 |
| (N) | 1.75 | 0.28 |

Image-receiving element (K) showed a lower $D_{max}$ value and a higher $D_{min}$ value as can be seen from the results shown in Table II, and the image obtained thereon exhibited a distortion. In contrast thereto, image-receiving elements (L) through (N) containing the compounds of the invention showed higher $D_{max}$ values and lower $D_{min}$ values; besides the images obtained thereon were sharp, exhibiting no distortion.

EXAMPLE 3

A light-sensitive element was prepared by coating the following layers, in sequence, on an acetylcellulose film base subbed on the surface with gelatin.

(1) Cyan dye developer layer 1,4-bis(α-methyl-β-hydroquinonylethylamino)-5,8-dihydroxyanthraquinone was dissolved in a mixture of N-n-butylacetanilide and 4-methylcyclohexanone and the resulting solution was emulsified by dispersing it in an aqueous gelatin solution containing Alkanol B as dispersing agent. The thus obtained emulsified dye developer dispersion was coated on the film base at a gelatin coverage of 4.2 g/m$^2$ and a cyan dye developer coverage of 2.0 g/m$^2$.

(2) Red-sensitive emulsion layer

A red-sensitive silver iodobromide emulsion was coated on the cyan dye developer layer at a silver coverage of 0.6 g/m$^2$ and a gelatin coverage of 2.4 g/m$^2$.

(3) Intermediate layer

An intermediate layer was coated on the red-sensitive emulsion layer by applying gelatin thereto at a gelatin coverage of 2.0 g/m$^2$.

(4) Magenta dye developer layer

2-[p-(β-hydroquinonylethyl)phenylazo]-4-n-propoxy-1-naphthol was dissolved in a mixture of N-n-butylacetanilide and 4-methylcyclohexanone and the resulting solution was dispersed in an aqueous gelatin solution containing Alkanol B as dispersing agent. The thus obtained emulsified dye developer dispersion was coated on the intermediate layer at a coverage of 2.8 g of gelatin per square meter and 1.3 g of the magenta dye developer per square meter.

(5) Green-sensitive emulsion layer

A green-sensitive silver iodobromide emulsion layer was coated on the magenta dye developer layer at a silver coverage of 1.2 g/m$^2$ and a gelatin coverage of 1.2 g/m$^2$.

(6) Intermediate layer

An intermediate layer was coated on the green-sensitive emulsion layer by applying gelatin thereto at a gelatin coverage of 1.5 g/m$^2$.

(7) Yellow dye developer layer

1-Phenyl-3-N-n-hexylcarboxamide-4-[(p-2',5'-dihydroxyphenetyl)phenylazo]-5-pyrazolone was dissolved in a mixture of N,N-diethyllauramide and the resulting solution was dispersed in an aqueous gelatin solution containing Alkanol B as dispersing agent. The thus obtained emulsified dye developer dispersion was coated on the intermediate layer at a coverage of 1.1 g of silver per square meter and 0.5 g of the yellow dye developer per square meter.

(8) Blue-sensitive emulsion layer

A blue-sensitive silver iodobromide emulsion was coated on the yellow dye developer layer at a silver coverage of 0.6 g/m$^2$ and a gelatin coverage of 0.6 g/m$^2$.

(9) Protective layer

4'-Methylphenylhydroquinone was dissolved in N,N-diethyllauramide and the resulting solution was emulsified by dispersing it in an aqueous gelatin solution containing Alkanol B as dispersing agent to prepare a coating liquid. Into 100 ml of the coating liquid was incorporated 5 ml of a 2% mucochloric acid and the resulting mixture was coated on the blue-sensitive emulsion layer at a coverage of 0.5 g of the 4'-methylphenylhydroquinone per square meter and 0.6 g of gelatin per square meter.

The following alkaline processing composition was used:

| Alkaline processing Composition | |
|---|---|
| Water | 100 ml |
| Potassium hydroxide | 11.2 g |
| Carboxymethyl cellulose | 5 g |
| Benzotriazole | 7.0 g |
| N-phenethyl-α-picolinium bromide | 2.0 g |
| Benzylaminopurine | 0.12 g |
| Titanium dioxide | 50 g |

A processing pod in which the above-described alkaline processing composition was contained was placed between the aforementioned light-sensitive element and one of the image-receiving elements (A) through (J) but outside of an image area of the light sensitive element, and the resulting stack was exposed to light through an optical wedge and then pressed by means of a press roller so that the pod was ruptured so as to effect a development treatment. The thus processed photographic element was allowed to stand at a temperature of 25° C. a relative humidity of 60% for 7 days. Thereafter, the maximum density ($D_{max}$) and minimum density ($D_{min}$) of each of the dye images obtained, i.e. cyan (C), magenta (M) and yellow (Y), were measured by the use of red, green and blue filters, respectively. The results obtained were as shown in Table III.

Table III

| Image-receiving element | $D_{max}$ | | | $D_{min}$ | | |
|---|---|---|---|---|---|---|
| | Cyan | Magenta | Yellow | Cyan | Magenta | Yellow |
| (A) | 1.85 | 1.81 | 1.60 | 0.21 | 0.33 | 0.45 |
| (B) | 2.10 | 1.97 | 1.90 | 0.08 | 0.13 | 0.27 |
| (C) | 2.09 | 1.98 | 1.92 | 0.09 | 0.14 | 0.20 |
| (D) | 2.05 | 1.99 | 1.96 | 0.10 | 0.15 | 0.29 |
| (E) | 2.03 | 1.98 | 1.93 | 0.11 | 0.14 | 0.27 |
| (F) | 2.09 | 1.97 | 1.89 | 0.09 | 0.15 | 0.19 |
| (G) | 2.08 | 2.01 | 1.90 | 0.10 | 0.13 | 0.21 |
| (H) | 2.05 | 2.00 | 1.97 | 0.08 | 0.15 | 0.23 |
| (I) | 2.06 | 1.98 | 1.92 | 0.09 | 0.15 | 0.22 |
| (J) | 2.07 | 1.96 | 1.94 | 0.11 | 0.16 | 0.22 |

As can be seen from the results shown in Table III, image-receiving element (A) showed a lower $D_{max}$ value and a higher $D_{min}$ value and besides, the dye image obtained thereon exhibited a distortion. In contrast thereto, image-receiving elements (B) through (J) containing the compounds of the invention showed higher $D_{max}$ values and lower $D_{min}$ values and besides, the dye images obtained thereon were sharp, exhibiting no distortion. Furthermore, yellow stainning was observed in image-receiving element (A), but not in image-receiving elements (B) through (J).

EXAMPLE 4

A light-sensitive element was prepared by coating the following layers, in sequence, on an acetylcellulose film base subbed on the surface with gelatin:

(1) On the subbed film base were coated a green-sensitive silver bromide emulsion at a silver coverage of 1.0 g/m$^2$ and a gelatin coverage of 2.6 g/m$^2$ and a potassium neutral salt of 1-phenyl-3-(3,5-disulfobenzamido)-4-(6-hydroxy-4-pentadecylphenylazo)-5-pyrazolone at a coverage of 0.8 g/m$^2$.

(2) Gelatin was coated thereon at a coverage of 2.0 g/m$^2$.

On each of the neutralization layers (A), (C), (E), (I) and (H) used in Example 1 and on a transparent polyethylene terephthalate film having thickness of 100μ coated in sequence the following layers to prepare image-receiving elements (O), (P), (Q), (R) and (S), respectively:

(1) Light Reflecting Layer

A light reflecting layer was coated on the neutralization layer at a coverage of 30 g of titanium oxide per square meter and 3 g of gelatin per square meter.

(2) Image-Receiving Layer

An image-receiving layer was coated on the light reflecting layer at a coverage of 5 g of gelatin per square meter and 2 g of octadecyltributylammonium bromide per square meter.

Protective Layer

A protective layer was coated on the image-receiving layer at a gelatin coverage of 0.6 g/m$^2$.

The following alkaline processing composition was used:

Alkaline processing composition:

| | |
|---|---|
| 4-Amino-N-ethyl-N-β-hydroxyethyl-aniline hydrochloride | 3 g |
| Hydroxyethyl cellulose | 3.2 g |
| Piperidinohexose reductone | 0.08 g |
| Sodium hydroxide | 3 g |

A processing pod in which the above-described alkaline processing composition was contained was placed between the aforementioned light-sensitive element and image-receiving element but outside an image area. The resulting stack was pressed by means of a press roller so that the processing pod was ruptured so as to effect a development treatment. Three minutes after the development treatment, the light-sensitive element and the image-receiving element were peeled off from each other. After the thus separated image-receiving element was allowed to stand at a temperature of 50° C. and a relative humidity of 80% for 3 days, the maximum density and minimum density of the image formed thereon were measured. The results were as shown in Table IV.

Table IV

| Image-receiving element | $D_{max}$ | $D_{min}$ |
|---|---|---|
| (O) | 1.20 | 0.40 |
| (P) | 1.50 | 0.21 |
| (Q) | 1.55 | 0.19 |
| (R) | 1.45 | 0.20 |
| (S) | 1.48 | 0.23 |

Image-receiving element (O) showed a lower $D_{max}$ value and a higher $D_{min}$ value and besides, the dye image obtained thereon exhibited a distortion. In contrast thereto, image-receiving elements (P) through (S) containing the compounds of the invention showed higher $D_{max}$ values and lower $D_{min}$ values and besides, the dye images obtained thereon were sharp, exhibiting no distortion.

EXAMPLE 5

To the intermediate layer in each of the image-receiving elements (A), (C), (E), (I) and (H) prepared in Example 1 but before coating the image receiving layer, were applied the following layers, in sequence, to prepare photographic elements (A), (B), (C), (D) and (E).

(1) Image-Receiving Layer

Polyvinylbenzyltrimethylammonium chloride and polyvinyl alcohol (Gosenol NH-26, manufactured by Nippon Gosei Kagaku Kogyo) were coated on the intermediate layer at coverages of 2 g/m$^2$ and 4 g/m$^2$, respectively.

(2) Light Reflecting Layer

A light reflecting layer was coated on the image-receiving layer by applying thereto titanium dioxide and gelatin at coverages of 20 g/m$^2$ and 2 g/m$^2$, respectively.

(3) Opacifying Layer

An opacifying layer was coated on the light reflecting layer by applying thereto gelatin and carbon black at coverages of 2 g/m$^2$ and 2 g/m$^2$, respectively.

(4) Layer Containing Yellow Dye Image-Forming Substance

A layer containing a yellow dye image-forming substance of the structural formula shown below was coated on the opacifying layer by applying thereto the substance and gelatin at coverages of 1 g/m$^2$ and 1 g/m$^2$, respectively.

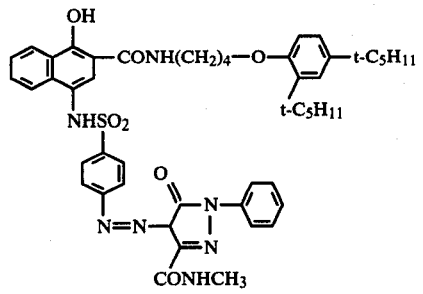

(5) Blue-Sensitive Emulsion Layer

A blue-sensitive emulsion layer was coated on the layer containing the yellow dye image-forming substance by applying thereto a blue-sensitive silver iodobromide emulsion at a silver coverage of 0.6 g/m$^2$ and a gelatin coverage of 0.6 g/m$^2$.

(6) Protective Layer

A protective layer was coated on the blue-sensitive emulsion layer by applying thereto gelatin at a coverage of 0.5 g/m$^2$.

As a cover sheet on the protective layer was used a transparent polyethylene terephthalate film base.

The following alkaline processing composition was used:

| | |
|---|---|
| Alkaline processing composition | |
| Hydroxyethyl cellulose | 2.5 g |
| Sodium hydroxide | 6.0 g |
| 4-Hydroxymethyl-4-methyl-1-phenyl-3-pyrazolidone | 0.8 g |
| Potassium iodide | 1 g |
| 5-Methylbenzotriazole | 80 mg |
| t-Butylhydroquinone | 80 mg |
| Sodium sulfate | 0.2 g |
| Carbon black | 4 g |
| Water | 100 ml |

A processing pod in which the alkaline processing composition was contained was placed between the aforementioned photographic element and cover sheet but outside an image area. The resulting stack was exposed to light and then pressed by means of a press roller so that the processing pod was ruptured so as to effect a development treatment. After the thus processed photographic element with a color image formed thereon was stored at a temperature of 50° C. and a relative humidity of 80% for 3 days, the maximum density and the minimum density were measured. The results were as shown in Table V.

Table V

| Photographic element | $D_{max}$ | $D_{min}$ |
|---|---|---|
| (A) | 1.30 | 0.39 |
| (B) | 1.49 | 0.20 |
| (C) | 1.51 | 0.21 |
| (D) | 1.62 | 0.17 |
| (E) | 1.59 | 0.18 |

Photographic element (A) showed a lower $D_{max}$ value and a $D_{min}$ value and besides, the dye image formed exhibited a distortion. In contrast thereto, photographic elements (B) through (E) containing the compounds of the invention showed higher $D_{max}$ values and lower $D_{min}$ values, and besides, the dye images obtained were sharp, exhibiting no distortion.

What we claim is:

1. In a diffusion transfer photographic material having therein a transparent support, having thereon a receiving layer, having thereon a silver halide emulsion layer, having thereon a neutralization layer, for lowering the pH value increased by application of an alkaline processing composition, the improvement comprising said neutralization layer having a copolymer containing, as monomer units, a first monomer represented by the following formula (I)

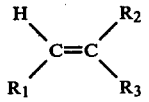

and a second monomer represented by the following formula (II)

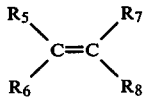

wherein $R_1$ is hydrogen, lower alkyl, —$COOR_4$,

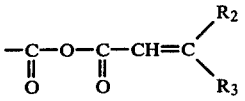

or phenyl; and $R_2$ and $R_3$ are individually hydrogen, halogen, or lower alkyl, provided that at least one of the designations $R_1$, $R_2$, and $R_3$ which may be the same or different from each other is a carboxyl group or a group hydrolyzable into a carboxyl group, and $R_4$ is hydrogen or lower alkyl; $R_5$, $R_6$, and $R_7$ are individually hydrogen or halogen; $R_8$ is selected from the group consisting of hydrogen, halogen, alkyl which may have at least one substituent selected from fluorine, —$COOR_9$ and —$COR_9$, phenyl which may have at least one substituent selected from fluorine, lower alkyl, lower alkyl substituted with at least one fluorine, —O—$R_9$, —O-$COR_9$, and

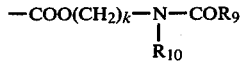

in which $R_9$ is hydrogen or alkyl, $R_{10}$ is lower alkyl and k is an integer of 1 to 5 inclusive, provided that at least one of $R_5$, $R_6$, $R_7$ and $R_8$ which may the same or different from each other represents fluorine or a group containing fluorine.

2. The diffusion transfer photographic material as claimed in claim 1 wherein $R_2$ and $R_3$ represent substituted alkyl represented by the formula: $-(CH_2)_{n-1}COOR_4$ and $R_1$ is phenyl substituted with —$COOR_4$ or

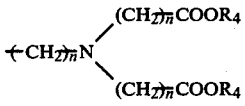

in which n is an integer of 1 or 2 and $R_4$ is hydrogen or lower alkyl.

3. The diffusion transfer photographic material as claimed in claim 1 wherein $R_8$ is an alkyl group having 1 to 12 carbon atoms and $R_9$ is an alkyl group having 1 to 18 carbon atoms.

4. The diffusion transfer photographic material as claimed in claim 3 wherein the C—C bond or bonds of the alkyl group for $R_9$ are separated by one or more oxygen atoms.

5. The diffusion transfer photographic material as claimed in claim 1 wherein $R_8$ is represented by the formula: $-(CH_2)_{n-1}COOR_9$ or $-(CH_2)_{n-1}COR_9$, wherein n is an integer selected from 1 and 2.

6. The diffusion transfer photographic material as claimed in claim 3 wherein $R_9$ is substituted with one or more fluorine atoms.

7. The diffusion transfer photographic material as claimed in claim 1 wherein $R_{10}$ is substituted with one or more fluorine atoms.

8. The diffusion transfer photographic material as claimed in claim 1 wherein the combined amount of said first monomer and said second monomer is not less than 50 mole % of the copolymer.

9. The diffusion transfer photographic material as claimed in claim 1 wherein the amount of the copolymer in the photographic material is 0.1–0.3 g per 100 $cm^2$ of the photographic material.

10. The diffusion transfer photographic material as claimed in claim 1 wherein the photographic material further comprises a timing layer between said neutralization layer and said emulsion layer.

11. The diffusion transfer photographic material as claimed in claim 1 wherein the neutralization layer is between said transparent support and said receiving layer.

12. The diffusion transfer photographic material as claimed in claim 11 wherein the photographic material further comprises a timing layer between said neutralization layer and said receiving layer.

13. The diffusion transfer photographic materials claimed in claim 1 wherein the amount of the copolymer in the photographic material is 0.15–0.25 g per 100 $cm^2$ of the photographic material.

* * * * *